US010495091B2

(12) United States Patent
Ueda et al.

(10) Patent No.: US 10,495,091 B2
(45) Date of Patent: Dec. 3, 2019

(54) ROTARY COMPRESSOR HAVING AN INJECTION CONNECTING PIPE THAT EXTENDS TO AN UPPER PORTION OF A COMPRESSOR HOUSING AND THAT IS LINKED TO AN INJECTION PIPE VIA AN INJECTION PIPE TAKING-OUT PORTION

(71) Applicant: FUJITSU GENERAL LIMITED, Kanagawa (JP)

(72) Inventors: Kenshi Ueda, Kanagawa (JP); Akira Inoue, Kanagawa (JP); Naoya Morozumi, Kanagawa (JP); Yasuyuki Izumi, Kanagawa (JP)

(73) Assignee: FUJITSU GENERAL LIMITED, Kanagawa (JP)

( * ) Notice: Subject to any disclaimer, the term of this patent is extended or adjusted under 35 U.S.C. 154(b) by 276 days.

(21) Appl. No.: 15/479,483

(22) Filed: Apr. 5, 2017

(65) Prior Publication Data

US 2017/0292520 A1 Oct. 12, 2017

(30) Foreign Application Priority Data

Apr. 12, 2016 (JP) ..... 2016-079693
Apr. 13, 2016 (JP) ..... 2016-080228

(51) Int. Cl.
*F03C 2/00* (2006.01)
*F03C 4/00* (2006.01)
(Continued)

(52) U.S. Cl.
CPC ..... *F04C 29/12* (2013.01); *F04C 18/3562* (2013.01); *F04C 29/0007* (2013.01);
(Continued)

(58) Field of Classification Search
CPC ..... F04C 18/3562; F04C 18/3564; F04C 29/0007; F04C 29/0085; F04C 29/12;
(Continued)

(56) References Cited

U.S. PATENT DOCUMENTS

2008/0236184 A1* 10/2008 Morozumi ..... F04C 18/3442 62/324.6
2009/0180907 A1* 7/2009 Ueda ..... F04C 23/001 418/11
(Continued)

FOREIGN PATENT DOCUMENTS

CA 2 099 989 C 3/2000
CN 103423163 A 12/2013
(Continued)

OTHER PUBLICATIONS

Extended European Search Report issued in corresponding European Patent Application No. 18185107.2, dated Sep. 21, 2018.
(Continued)

*Primary Examiner* — Theresa Trieu
(74) *Attorney, Agent, or Firm* — McDermott Will & Emery LLP

(57) ABSTRACT

A compressor includes: an annular cylinder; a rotation shaft which is rotated by the motor; a piston which revolves along an inner circumferential surface of the cylinder, and forms a cylinder chamber on the inside of the cylinder; a vane which protrudes to the inside of the cylinder chamber from a vane groove provided in the cylinder, and divides the cylinder chamber into an inlet chamber and a compression chamber by abutting against the piston; and an injection hole which injects a liquid refrigerant to the inside of the compression chamber. The center of the injection hole is disposed to be within a fan-like range of which a center angle is equal to or less than 40° toward a side opposite to a connection position between the compressor housing and the inlet unit from a
(Continued)

center line of the vane groove in the circumferential direction of the rotation shaft.

5 Claims, 7 Drawing Sheets

(51) Int. Cl.

| | |
|---|---|
| ***F04C 2/00*** | (2006.01) |
| ***F04C 11/00*** | (2006.01) |
| ***F04C 29/12*** | (2006.01) |
| ***F04C 29/00*** | (2006.01) |
| ***F04C 18/356*** | (2006.01) |
| *F04C 23/00* | (2006.01) |

(52) U.S. Cl.
CPC ..... *F04C 29/0085* (2013.01); *F04C 23/001* (2013.01); *F04C 2240/30* (2013.01); *F04C 2240/60* (2013.01); *F04C 2240/804* (2013.01); *F04C 2240/806* (2013.01)

(58) Field of Classification Search
CPC .. F04C 23/001; F04C 23/008; F04C 2240/30; F04C 2240/60; F04C 2240/804; F04C 2240/806
USPC ..... 418/11, 60, 270, DIG. 1
See application file for complete search history.

(56) References Cited

U.S. PATENT DOCUMENTS

2010/0064707 A1* 3/2010 Sato ..... F04C 23/001 417/250
2012/0174619 A1* 7/2012 Ogata ..... F04C 18/3564 418/248

FOREIGN PATENT DOCUMENTS

| | | | |
|---|---|---|---|
| CN | 105402128 | A | 3/2016 |
| JP | 61-079893 | A | 4/1986 |
| JP | 2003-343467 | A | 12/2003 |
| JP | 3979407 | B2 | 9/2007 |
| JP | 2015-135090 | A | 7/2015 |
| WO | 2009/059488 | A1 | 5/2009 |

OTHER PUBLICATIONS

Partial European Search Report issued in corresponding European Patent Application No. 17166022.8, dated Sep. 27, 2017.
Office Action issued in corresponding Chnese Patent Application No. 201710212743.9, dated Jul. 29, 2019.

* cited by examiner

ROTARY COMPRESSOR HAVING AN INJECTION CONNECTING PIPE THAT EXTENDS TO AN UPPER PORTION OF A COMPRESSOR HOUSING AND THAT IS LINKED TO AN INJECTION PIPE VIA AN INJECTION PIPE TAKING-OUT PORTION

CROSS-REFERENCE TO RELATED APPLICATION

This application is based upon and claims the benefit of priorities from Japanese Patent Application No. 2016-079693 filed on Apr. 12, 2016; and Japanese Patent Application No. 2016-080228 filed on Apr. 13, 2016; the entire contents of which are incorporated herein by reference.

FIELD

The present invention relates to a rotary compressor.

BACKGROUND

There is a rotary compressor which is provided with an injection hole that injects a liquid refrigerant (injection liquid) to a compression chamber during compression of the refrigerant in a cylinder, in order to improve compression efficiency of the refrigerant. As a rotary compressor of the related technology, a configuration in which an injection hole is provided on an intermediate partition plate disposed between an upper cylinder and a lower cylinder, or a configuration in which an injection hole is provided in a cylinder, is known.

In addition, there is a rotary compressor which is provided with an accumulator that supplies the refrigerant to the inside of a compressor housing. In this type of the rotary compressor, an inlet pipe which is linked to the accumulator is connected to an outer circumferential surface of the compressor housing.

As a rotary compressor of a related technology, a configuration in which an injection pipe which injects a liquid refrigerant to the inside of a cylinder during the compression of the refrigerant in order to improve compression efficiency of the refrigerant on the inside of the cylinder, is known. One end portion of the injection pipe is disposed in an injection pipe taking-out portion provided in an outer circumferential portion of the compressor housing, and is connected to an injection connecting pipe via the injection pipe taking-out portion. In addition, the injection pipe taking-out portion is disposed on a side opposite to an accumulator, that is, a side opposite to a connection position between the compressor housing and the inlet pipe, in the circumferential direction of the compressor housing, and the injection connecting pipe is disposed along an outer circumferential surface of the compressor housing on the side opposite to the accumulator.

Examples of related art include Japanese Patent No. 3979407 and Japanese Laid-open Patent Publication No. 2003-343467.

In the above-described rotary compressor, the liquid refrigerant is injected to the inside of the compressor chamber against a pressure of the refrigerant which is during the compression in the compression chamber. Therefore, in a compression cycle, in accordance with a timing of injecting the liquid refrigerant to the inside of the compressor chamber, there is a tendency for an inlet amount by which the liquid refrigerant is suctioned to the inside of the compression chamber to fluctuate. Since the compression efficiency in the compression cycle which continues after the injection of the liquid refrigerant changes according to the change in inlet amount of the liquid refrigerant, it is desirable to suppress the fluctuation in compression efficiency, and to improve compression efficiency by setting the inlet amount of the liquid refrigerant to be appropriate.

In addition, the rotary compressor provided with the above-described accumulator has the accumulator attached to the compressor housing, and is shipped as a product in a state where one end portion of the injection connecting pipe is connected to the compressor housing. The rotary compressor is used together with an air conditioner as the injection introduction pipe for introducing the liquid refrigerant is connected to the connection portion which is the other end portion of the injection connecting pipe whose one end portion is connected to the compressor housing, by a user. At this time, the injection introduction pipe is bonded to the connection portion of the injection connecting pipe by welding.

However, in accordance with a change in structure of the rotary compressor, in a case where the injection pipe is disposed to be near a connection position between the compressor housing and the inlet pipe, the injection connecting pipe approaches the accumulator. Therefore, when work of welding the injection introduction pipe to the connection portion of the injection connecting pipe is performed, a welding tool is likely to come into contact with the accumulator, and there is a concern that the welding work is interrupted. In addition, there is also a concern that heat generated in a welding portion of the welding tool influences the accumulator.

SUMMARY

Considering the above-described situation, an object of the invention is to provide a rotary compressor which can improve compression efficiency of a refrigerant. In addition, an another object of the invention is to provide a rotary compressor which can improve workability of welding an injection introduction pipe to a connection portion of an injection connecting pipe.

According to an aspect of the invention, there is provided a rotary compressor including: a sealed vertically-placed cylindrical compressor housing in which a discharging unit for a refrigerant is provided in an upper portion, and an inlet unit for the refrigerant is provided in a lower portion; a compressing unit which is disposed in the lower portion of the inside of the compressor housing, which compresses the refrigerant suctioned from the inlet unit, and which discharges the refrigerant from the discharging unit; and a motor which is disposed in the upper portion of the inside of the compressor housing, and which drives the compressing unit, in which the compressing unit includes an annular cylinder, an upper end plate which closes an upper side of the cylinder, a lower end plate which closes a lower side of the cylinder, a rotation shaft which has an eccentric portion and which is rotated by the motor, a piston which is fitted to the eccentric portion, which revolves along an inner circumferential surface of the cylinder, and which forms a cylinder chamber on the inside of the cylinder, a vane which protrudes to the inside of the cylinder chamber from a vane groove provided in the cylinder, and which divides the cylinder chamber into an inlet chamber and a compression chamber by abutting against the piston, an injection hole which injects a liquid refrigerant to the inside of the compression chamber, and a discharge hole which discharges the refrigerant compressed on the inside of the compression chamber from the inside of the compression chamber, and in which the center of the injection hole is disposed to be within a fan-like range whose center angle is equal to or less than 40° toward a side opposite to a connection position between the compressor housing and the inlet unit from a center line of the vane groove in the circumferential direction of the rotation shaft.

According to another aspect of the invention, there is provided a rotary compressor including: a sealed vertically-placed cylindrical compressor housing in which a discharging unit for a refrigerant is provided in an upper portion, and an inlet unit for the refrigerant is provided in a lower portion; a compressing unit which is disposed in the lower portion of the inside of the compressor housing, which compresses the refrigerant suctioned from the inlet unit, and which discharges the refrigerant from the discharging unit; a motor which is disposed in the upper portion of the inside of the compressor housing, and which drives the compressing unit; and an accumulator which is fixed to an outer circumferential surface of the compressor housing, and which is connected to the inlet unit, in which the compressing unit includes an annular cylinder, an upper end plate which closes an upper side of the cylinder, a lower end plate which closes a lower side of the cylinder, a rotation shaft which has an eccentric portion and which is rotated by the motor, a piston which is fitted to the eccentric portion, which revolves along an inner circumferential surface of the cylinder, and which forms a cylinder chamber on the inside of the cylinder, and a vane which protrudes to the inside of the cylinder chamber from a vane groove provided in the cylinder, and which divides the cylinder chamber into an inlet chamber and a compression chamber by abutting against the piston, in which the rotary compressor includes an injection pipe for injecting a liquid refrigerant to the inside of the compression chamber, an injection pipe taking-out portion which is provided on an outer circumferential surface of the compression housing, and to which one end portion of the injection pipe is fixed, and an injection connecting pipe in which one end portion thereof is linked to the injection pipe via the injection pipe taking-out portion, in which a center line of the injection pipe taking-out portion is disposed to be within a fan-like range of which a center angle is equal to or less than 60° toward the vane groove side from a center line of a connection position between the compressor housing and the inlet unit, in the circumferential direction of the outer circumferential surface of the compressor housing, and in which the other end portion of the injection connecting pipe which extends in the direction of being separated from the inlet unit in the circumferential direction of the outer circumferential surface of the compressor housing, and which extends to the upper portion of the compressor housing.

In the rotary compressor according to one aspect of the invention, it is possible to improve compression efficiency of the refrigerant.

In addition, in the rotary compressor according to another aspect of the invention, it is possible to improve workability of welding the injection introduction pipe to the connection portion of the injection connecting pipe.

DESCRIPTION OF EMBODIMENTS

Hereinafter, embodiments of a rotary compressor of the invention will be described in detail based on the drawings. In addition, the rotary compressor of the invention is not limited to the following embodiments.

First Embodiment

Configuration of Rotary Compressor

Figure 1:
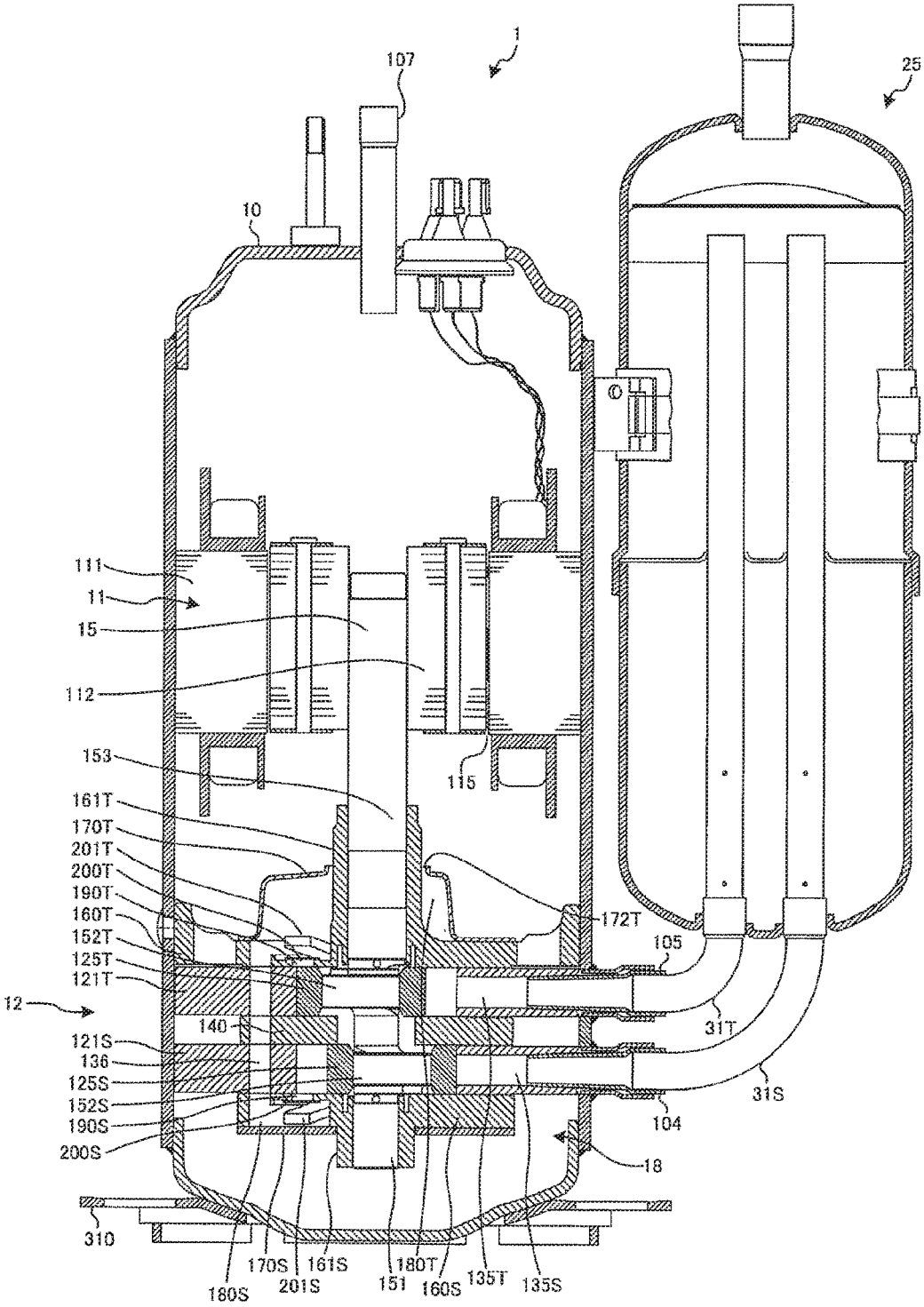
FIG. 1 is a longitudinal sectional view illustrating a rotary compressor according to first and second embodiments.
Figure 2:
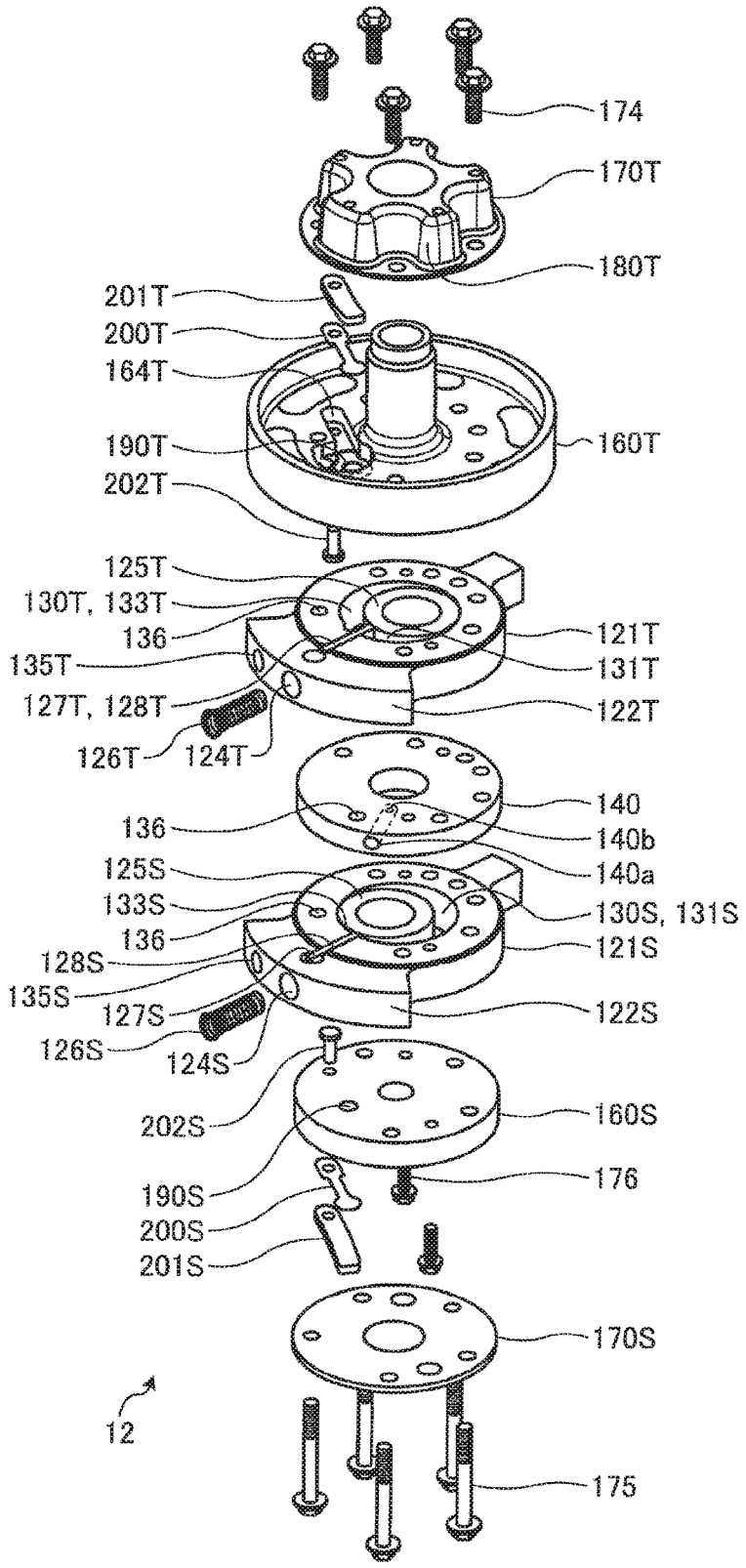
FIG. 2 is an exploded perspective view illustrating a compressing unit of the rotary compressor according to the first and second embodiments.
Figure 3:
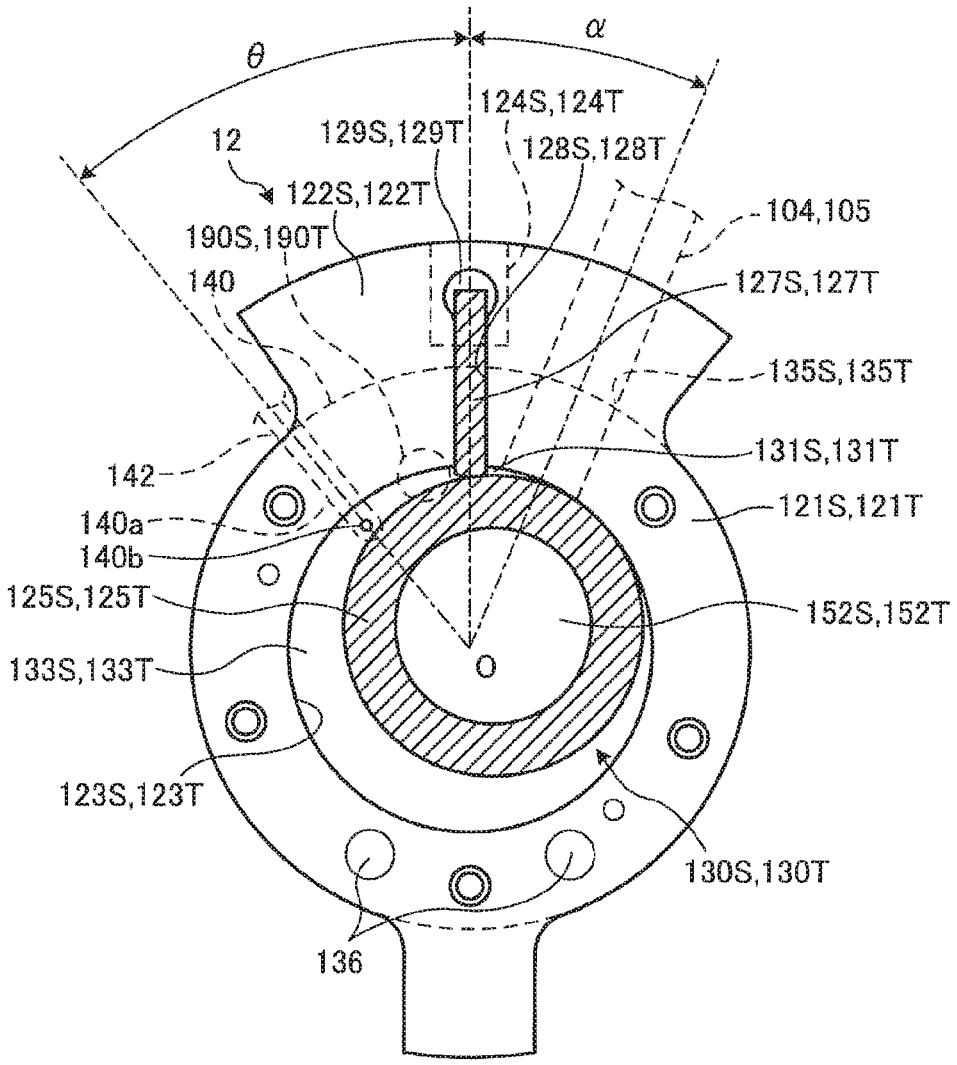
FIG. 3 is a lateral sectional view when the compressing unit of the rotary compressor according to the first embodiment is viewed from above.

FIG. 1 is a longitudinal sectional view illustrating a rotary compressor according to a first embodiment. FIG. 2 is an exploded perspective view illustrating a compressing unit of the rotary compressor according to the first embodiment. FIG. 3 is a lateral sectional view when the compressing unit of the rotary compressor according to the first embodiment is viewed from above.

As illustrated in FIG. 1, a rotary compressor 1 includes: a compressing unit 12 which is disposed in a lower portion of the inside of a sealed vertically-placed cylindrical compressor housing 10; a motor 11 which is disposed on an upper portion of the inside of the compressor housing 10, and drives compressing unit 12 via a rotation shaft 15; and a sealed vertically-placed cylindrical accumulator 25 which is fixed to an outer circumferential surface of the compressor housing 10.

The cylindrical accumulator 25 is connected to an upper cylinder chamber 130T (refer to FIG. 2) of an upper cylinder 121T via an inlet unit configured of an upper inlet pipe 105 and an accumulator upper curved pipe 31T, and is connected to a lower cylinder chamber 130S (refer to FIG. 2) of a lower cylinder 121S via an inlet unit configured of a lower inlet pipe 104 and an accumulator lower curved pipe 31S. In the embodiment, in the circumferential direction of the compressor housing 10, positions of the upper inlet pipe 105 and the lower inlet pipe 104 overlap each other, and are positioned on the same circumferential surface.

The motor 11 includes a stator 111 which is disposed on an outer side, and a rotor 112 which is disposed on an inner side. The stator 111 is fixed to an inner circumferential surface of the compressor housing 10 in a shrink fit state, and the rotor 112 is fixed to the rotation shaft 15 in a shrink fit state.

In the rotation shaft 15, a sub-shaft unit 151 on a lower side of a lower eccentric portion 152S is supported to be freely rotated by a sub-bearing unit 161S provided in a lower end plate 160S, and a main shaft unit 153 on an upper side of an upper eccentric portion 152T is supported to be freely rotated by a main bearing unit 161T provided in an upper end plate 160T. The rotation shaft 15 is supported to be freely rotated with respect to the entire compressing unit 12 as each of an upper piston 125T and a lower piston 125S is supported by the upper eccentric portion 152T and the lower eccentric portion 152S which are provided by applying a phase difference of 180° therebetween. In addition, by the rotation of the rotation shaft 15, the upper piston 125T and the lower piston 125S are operated to revolve along the inner circumferential surfaces of each of the upper cylinder 121T and the lower cylinder 121S.

In order to ensure sliding properties of a sliding portion, such as the upper piston 125T and the lower piston 125S, which slide in the compressing unit 12, and to seal an upper compression chamber 133T (refer to FIG. 2) and a lower compression chamber 133S (refer to FIG. 2), lubricant oil 18 having an amount by which the compressing unit 12 is substantially immersed is sealed on the inside of the compressor housing 10. An attachment leg 310 (refer to FIG. 1) which locks a plurality of elastic supporting members (not illustrated) that support the entire rotary compressor 1 is fixed to a lower side of the compressor housing 10.

As illustrated in FIG. 1, the compressing unit 12 compresses a refrigerant suctioned from the upper inlet pipe 105 and the lower inlet pipe 104, and discharges the refrigerant from a discharge pipe 107 which will be described later. As described in FIG. 2, the compressing unit 12 is configured by stacking an upper end plate cover 170T including a bulging portion in which a hollow space is formed in an inner portion, the upper end plate 160T, the annular upper cylinder 121T, an intermediate partition plate 140, the annular lower cylinder 121S, the lower end plate 160S, and a flat plate-like lower end plate cover 170S, in order from above. The entire compressing unit 12 is fixed by a plurality of penetrating bolts 174 and 175 and an auxiliary bolt 176 which are disposed on a substantially concentric circle from above and below.

As illustrated in FIG. 3, in the upper cylinder 121T, an upper cylinder inner wall 123T is formed along the circle concentric to the rotation shaft 15 of the motor 11. On the inside of the upper cylinder inner wall 123T, the upper piston 125T which has an outer diameter smaller than an inner diameter of the upper cylinder 121T is disposed, and between the upper cylinder inner wall 123T and the upper piston 125T, the upper compression chamber 133T which suctions, compresses, and discharges the refrigerant is formed. In the lower cylinder 121S, along the circle concentric to the rotation shaft 15 of the motor 11, a lower cylinder inner wall 123S is formed. On the inside of the lower cylinder inner wall 123S, the lower piston 125S which has an outer diameter smaller than an inner diameter of the lower cylinder 121S is disposed, and between the lower cylinder inner wall 123S and the lower piston 125S, the lower compression chamber 133S which suctions, compresses, and discharges the refrigerant is formed.

As illustrated in FIGS. 2 and 3, the upper cylinder 121T has an upper side protruding portion 122T which is overhung in the radial direction of the rotation shaft 15 from a round outer circumferential portion. In the upper side protruding portion 122T, an upper vane groove 128T which extends from the upper cylinder chamber 130T to the outside in a radial shape, is provided. On the inside of the upper vane groove 128T, an upper vane 127T is disposed to be slidable. The lower cylinder 121S has a lower side protruding portion 122S which is overhung in the radial direction of the rotation shaft 15 from the round outer circumferential portion. In the lower side protruding portion 122S, a lower vane groove 128S which extends from the lower cylinder chamber 130S to the outside in a radial shape, is provided. On the inside of the lower vane groove 128S, a lower vane 127S is disposed to be slidable.

The upper side protruding portion 122T and the lower side protruding portion 122S are formed across a predetermined protruding range along the circumferential direction of the rotation shaft 15. The upper side protruding portion 122T and the lower side protruding portion 122S are used as a chuck holding unit to be fixed to a processing jig when performing processing of the upper cylinder 121T and the lower cylinder 121S.

At a position which overlaps the upper vane groove 128T from the outside surface of the upper side protruding portion 122T, an upper spring hole 124T is provided at a depth which does not reach the upper cylinder chamber 130T. An upper spring 126T is disposed in the upper spring hole 124T. At a position which overlaps the lower vane groove 128S from the outside surface of the lower side protruding portion 122S, a lower spring hole 124S is provided at a depth which does not reach the lower cylinder chamber 130S. A lower spring 126S is disposed in the lower spring hole 124S.

In addition, in the lower cylinder 121S, a lower pressure guiding-in path 129S which communicates with the outer side in the radial direction of the lower vane groove 128S and the inside of the compressor housing 10, introduces the compressed refrigerant on the inside of the compressor housing 10, and applies a back pressure to the lower vane 127S by a pressure of the refrigerant, is formed. In addition, in the upper cylinder 121T, an upper pressure guiding-in path 129T which communicates with the outer side in the radial direction of the upper vane groove 128T and the inside of the compressor housing 10 by an opening portion, introduces the compressed refrigerant on the inside of the compressor housing 10, and applies a back pressure to the upper vane 127T by a pressure of the refrigerant, is formed.

As illustrated in FIG. 3, in the upper side protruding portion 122T of the upper cylinder 121T, an upper inlet hole 135T which is fitted to the upper inlet pipe 105 is provided. In the lower side protruding portion 122S of the lower cylinder 121S, a lower inlet hole 135S which is fitted to the lower inlet pipe 104 is provided.

As illustrated in FIG. 2, upper and lower parts of the upper cylinder chamber 130T are closed by each of the upper end plate 160T and the intermediate partition plate 140. Upper and lower parts of the lower cylinder chamber 130S is closed by each of the intermediate partition plate 140 and the lower end plate 160S.

As illustrated in FIG. 3, as the upper vane 127T is pressed to the upper spring 126T, and abuts against the outer circumferential surface of the upper piston 125T, the upper cylinder chamber 130T is divided into an upper inlet chamber 131T which communicates with the upper inlet hole 135T, and the upper compression chamber 133T which communicates with an upper discharge hole 190T provided in the upper end plate 160T. As the lower vane 127S is pressed to the lower spring 126S, and abuts against the outer circumferential surface of the lower piston 125S, the lower cylinder chamber 130S is divided into a lower inlet chamber 131S which communicates with the lower inlet hole 135S, and the lower compression chamber 133S which communicates with a lower discharge hole 190S provided in the lower end plate 160S.

In addition, the upper discharge hole 190T is provided in the vicinity of the upper vane groove 128T, and the lower discharge hole 190S is provided in the vicinity of the lower vane groove 128S. The refrigerant which is compressed on the inside of the upper compression chamber 133T and on the inside of the lower compression chamber 133S, are discharged from the inside of the upper compression chamber 133T and the inside of the lower compression chamber 133S, through the upper discharge hole 190T and the lower discharge hole 190S.

Figure 4:
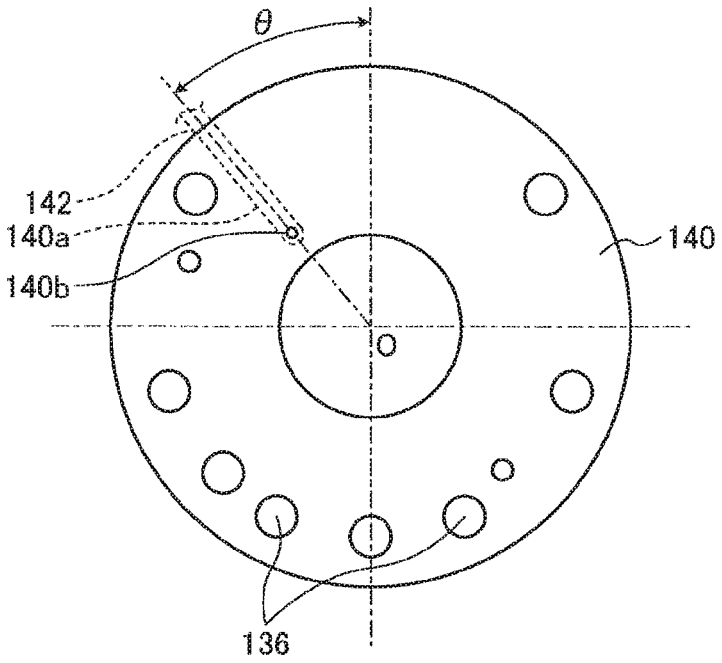
FIG. 4 is a plan view illustrating an intermediate partition plate of the rotary compressor according to the first embodiment.

In the intermediate partition plate 140, as illustrated in FIGS. 3 and 4, a connection hole 140*a* is formed along the radial direction of the intermediate partition plate 140, and an injection pipe 142 for injecting the liquid refrigerant to the inside of the upper compression chamber 133T and the inside of the lower compression chamber 133S is fitted to the connection hole 140*a*. In addition, injection holes 140*b* which communicate with the connection hole 140*a* and penetrate the intermediate partition plate 140 in the thickness direction (the direction of the rotation shaft 15) are provided respectively on both upper and lower surfaces of the intermediate partition plate 140.

One end portion of the injection pipe 142 is disposed on the outer circumferential surface of the compressor housing 10, and is connected to the injection connecting pipe (not illustrated). The liquid refrigerant is introduced into the injection connecting pipe from a refrigerant circulating path. In the rotary compressor 1, compression efficiency of the refrigerant is improved by injecting the liquid refrigerant supplied from the injection pipe 142, to the inside of the upper compression chamber 133T and the inside of the lower compression chamber 133S from each injection hole 140*b* of the intermediate partition plate 140, and by lowering the temperature of the refrigerant during the compression.

As illustrated in FIG. 2, in the upper end plate 160T, the upper discharge hole 190T which penetrates the upper end plate 160T and communicates with the upper compression chamber 133T of the upper cylinder 121T, is provided, and an upper valve seat (not illustrated) is formed around the upper discharge hole 190T on an outlet side of the upper discharge hole 190T. In the upper end plate 160T, an upper discharge valve accommodation concave portion 164T which extends from a position of the upper discharge hole 190T in a shape of a groove in the circumferential direction of the upper end plate 160T, is formed.

In the upper discharge valve accommodation concave portion 164T, all of a reed valve type upper discharge valve 200T which includes a rear end portion fixed to the inside of the upper discharge valve accommodation concave portion 164T by an upper rivet 202T, and a front portion which opens and closes the upper discharge hole 190T; and an upper discharge valve cap 201T which overlaps the upper discharge valve 200T, and includes a rear end portion fixed to the inside of the upper discharge valve accommodation concave portion 164T by the upper rivet 202T, and a curved (distorted) front portion which controls an opening degree of the upper discharge valve 200T, are accommodated.

In the lower end plate 160S, the lower discharge hole 190S which penetrates the lower end plate 160S and communicates with the lower compression chamber 133S of the lower cylinder 121S, is provided. In the lower end plate 160S, a lower discharge valve accommodation concave portion (not illustrated) which extends from the position of the lower discharge hole 190S in a shape of a groove in the circumferential direction of the lower end plate 160S, is formed.

In the lower discharge valve accommodation concave portion, all of a reed valve type lower discharge valve 200S which includes a rear end portion fixed to the inside of the lower discharge valve accommodation concave portion by a lower rivet 202S, and a front portion which opens and closes the lower discharge hole 190S; and a lower discharge valve cap 201S which overlaps the lower discharge valve 200S, and includes a rear end portion fixed to the inside of the lower discharge valve accommodation concave portion by the lower rivet 202S, and a curved (distorted) front portion which controls an opening degree of the lower discharge valve 200S, are accommodated.

Between the upper end plate 160T and the upper end plate cover 170T having a bulging portion which are fixed to adhere to each other, an upper end plate cover chamber 180T is formed. Between the lower end plate 160S and the flat plate-like lower end plate cover 170S which are fixed to adhere to each other, a lower end plate cover chamber 180S (refer to FIG. 1) is formed. A refrigerant path hole 136 which penetrates the lower end plate 160S, the lower cylinder 121S, the intermediate partition plate 140, the upper end plate 160T, and the upper cylinder 121T, and communicates with the lower end plate cover chamber 180S and the upper end plate cover chamber 180T, is provided.

Hereinafter, a flow of the refrigerant due to the rotation of the rotation shaft 15 will be described. On the inside of the upper cylinder chamber 130T, as the upper piston 125T which is fitted to the upper eccentric portion 152T of the rotation shaft 15 revolves along the outer circumferential surface (the inner circumferential surface of the upper cylinder 121T) of the upper cylinder chamber 130T due to the rotation of the rotation shaft 15, the upper inlet chamber 131T suctions the refrigerant from the upper inlet pipe 105 while enlarging capacity, the upper compression chamber 133T compresses the refrigerant while reducing the capacity, and when the pressure of the compressed refrigerant becomes higher than the pressure of the upper end plate cover chamber 180T on the outer side of the upper discharge valve 200T, the upper discharge valve 200T is open, and the refrigerant is discharged to the upper end plate cover chamber 180T from the upper compression chamber 133T. The refrigerant discharged to the upper end plate cover chamber 180T is discharged to the inside of the compressor housing 10 from an upper end plate cover discharge hole 172T (refer to FIG. 1) provided in the upper end plate cover 170T.

In addition, in the lower cylinder chamber 130S, as the lower piston 125S fitted to the lower eccentric portion 152S of the rotation shaft 15 revolves along the outer circumferential surface (the inner circumferential surface of the lower cylinder 121S) of the lower cylinder chamber 130S due to the rotation of the rotation shaft 15, the lower inlet chamber 131S suctions the refrigerant from the lower inlet pipe 104 while enlarging the capacity, the lower compression chamber 133S compresses the refrigerant while reducing the capacity, and when the pressure of the compressed refrigerant becomes higher than the pressure of the lower end plate cover chamber 180S on the outer side of the lower discharge valve 200S, the lower discharge valve 200S is open, and the refrigerant is discharged to the lower end plate cover chamber 180S from the lower compression chamber 133S. The refrigerant discharged to the lower end plate cover chamber 180S is discharged to the inside of the compressor housing 10 from the upper end plate cover discharge hole 172T provided in the upper end plate cover 170T through the refrigerant path hole 136 and the upper end plate cover chamber 180T.

The refrigerant discharged to the inside of the compressor housing 10 is guided to the upper part of the motor 11 through a cutout (not illustrated) which is provided on the outer circumference of the stator 111, and communicates with the upper and lower parts, a void (not illustrated) of a winding portion of the stator 111, or a void 115 (refer to FIG. 1) between the stator 111 and the rotor 112, and is discharged from the discharge pipe 107 which serves as a discharging unit disposed in the upper portion of the compressor housing 10.

Characteristic Configuration of Rotary Compressor

Next, a characteristic configuration of the rotary compressor 1 according to the first embodiment will be described. FIG. 4 is a plan view illustrating the intermediate partition plate 140 of the rotary compressor 1 according to the first embodiment.

As illustrated in FIGS. 3 and 4, in the embodiment, in order to improve the compression efficiency of the refrigerant, in the circumferential direction of the rotation shaft 15, the injection hole 140*b* is disposed to be near the upper vane groove 128T and the lower vane groove 128S (the upper vane 127T and the lower vane 127S).

Specifically, as illustrated in FIG. 3, when viewed from the direction of the rotation shaft 15, in the circumferential direction of the rotation shaft 15, the center of the injection hole 140*b* is disposed to be within a fan-like range whose center angle θ is equal to or less than 40° around a center O of the rotation shaft 15, toward a side opposite to a connection position between the compressor housing 10 and the upper inlet pipe 105 and the lower inlet pipe 104, from a center line of the upper vane groove 128T and the lower vane groove 128S (the upper vane 127T and the lower vane 127S).

In other words, in the circumferential direction of the rotation shaft 15, the center of the injection hole 140*b* is disposed to be within a fan-like range whose center angle θ is equal to or less than 40° around the center O of the rotation shaft 15, in the direction reverse to the revolving direction of the upper piston 125T and the lower piston 125S on the inside of the upper cylinder chamber 130T and the inside of the lower cylinder chamber 130S, that is, in the direction reverse to the rotational direction of the rotation shaft 15, from a center line of the upper vane groove 128T and the lower vane groove 128S.

In addition, in the embodiment, in the circumferential direction of the rotation shaft 15, the center line of the upper vane groove 128T and the lower vane groove 128S (the upper vane 127T and the lower vane 127S) is disposed to make a center angle α (°) around the center O of the rotation shaft 15 with respect to the center line of the connection position between the compressor housing 10 and the upper inlet pipe 105 and the lower inlet pipe 104.

In the embodiment, the center angle θ considers each center line along the radial direction of the rotation shaft 15 as a reference in the upper inlet pipe 105 and the lower inlet pipe 104, and in the upper vane groove 128T and the lower vane groove 128S, in the circumferential direction of the rotation shaft 15, and indicates an angle made by two line segments (radius) which link both ends of an arc and the center O of the rotation shaft 15. In addition, in the embodiment, as illustrated in FIG. 3, the center of the injection hole 140*b* is positioned on the center line (on the center line of the connection hole 140*a* to which the injection pipe 142 is fitted) of the injection pipe 142 which extends in the radial direction of the rotation shaft 15. In addition, the center of the injection hole 140*b* is not limited to the configuration of being positioned on the center line of the injection pipe 142.

Relationship Between Center Angle of Injection Hole and COP

Figure 5:
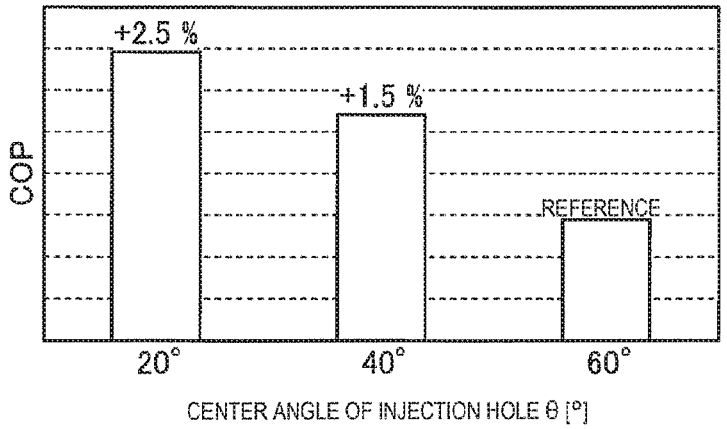
FIG. 5 is a view illustrating a change in COP with respect to a center angle of an injection hole in the rotary compressor according to the first embodiment.

A relationship between the center angle θ of the injection hole 140*b* and the COP (coefficient of performance) will be described with reference to the drawings. The COP illustrates energy consumption efficiency in an air conditioning apparatus employing the rotary compressor 1, which is a so-called air conditioner, and illustrates a performance of cooling and heating with respect to the power consumption. As COP increases, the energy consumption efficiency increases. FIG. 5 is a view illustrating a change in COP with respect to the center angle θ of the injection hole 140*b* in the rotary compressor 1 according to the first embodiment. In FIG. 5, a vertical axis illustrates the COP, and a horizontal axis illustrates the center angle θ (°) made by the center of the injection hole 140*b* with respect to the center line of the upper vane groove 128T and the lower vane groove 128S.

FIG. 5 is a result of comparison of the COP of the air conditioning apparatus when the injection is performed and the rotary compressor 1 is operated, by using alternate chlorofluorocarbon HFC (R410A) as the refrigerant. As illustrated in FIG. 5, when a case where the center angle θ of the injection hole 140*b* is 60° is considered as a reference, the COP increases by approximately 1.5% when the center angle θ is 40°, and increases by approximately 2.5% when the center angle θ is 20°.

Considering the description above, as the injection hole 140*b* is disposed to be within a fan-like range in which the center angle θ satisfies θ≤40°, the COP of the air conditioning apparatus is improved, and an effect of improving the compression efficiency of the refrigerant can be efficiently obtained. In addition, a case where the injection hole 140*b* is disposed to be within a fan-like range in which the center angle θ satisfies θ≤20°, is preferable since the COP of the air conditioning apparatus is further improved, and the compression efficiency is further improved. A case where the injection hole 140*b* is disposed to be within a range in which the center angle θ exceeds 40°, is not preferable since an effect of improving the COP of the air conditioning apparatus cannot be sufficiently obtained when the injection is performed and the rotary compressor 1 is operated, and the compression efficiency is not efficiently improved.

In other words, as the injection hole 140*b* is disposed so that the above-described center angle θ is satisfied in the circumferential direction of the rotation shaft 15, the liquid refrigerant is injected at a timing of becoming equal to or less than the final ⅙ of the cycle (the center angle θ is equal to or less than 40°) in a later stage of the compression cycle of the refrigerant on the inside of the upper compression chamber 133T and on the inside of the lower compression chamber 133S. Accordingly, since the liquid refrigerant is suctioned in a state where the pressure of the refrigerant during the compression increases to be close to the discharge pressure on the inside of the upper compression chamber 133T and on the inside of the lower compression chamber 133S, the inlet amount of the liquid refrigerant suctioned to the inside of the upper compression chamber 133T and the inside of the lower compression chamber 133S is controlled by the pressure on the inside of the upper compression chamber 133T and the inside of the lower compression chamber 133S, the inlet amount of the liquid refrigerant decreases to an appropriate amount, and energy required for compressing the refrigerant in the remaining compression cycle which continues after the injection of the liquid refrigerant, is suppressed to be small. As a result, by efficiently performing the remaining compression cycle which continues after the injection of the liquid refrigerant, the compression efficiency of the refrigerant is improved.

Meanwhile, in a case where the injection hole 140*b* is disposed to be near the upper vane groove 128T and the lower vane groove 128S, since the pressure of the upper discharge hole 190T and the lower discharge hole 190S which are disposed to be near the upper vane groove 128T and the lower vane groove 128S is high, the liquid refrigerant is unlikely to enter the inside of the upper compression chamber 133T and the lower compression chamber 133S from the injection hole 140*b*. Therefore, when viewed from the direction of the rotation shaft 15, it is preferable that the injection hole 140*b* approaches the upper vane groove 128T and the lower vane groove 128S, and is disposed to be more separated from the upper vane groove 128T and the lower vane groove 128S than the upper discharge hole 190T and the lower discharge hole 190S, to the side opposite to the connection position between the compressor housing 10 and the upper inlet pipe 105 and the lower inlet pipe 104.

Therefore, as illustrated in FIG. 3, in the circumferential direction of the rotation shaft 15, the injection hole 140*b* is more separated from the upper vane groove 128T and the lower vane groove 128S than the upper discharge hole 190T and the lower discharge hole 190S which are respectively near the upper vane groove 128T and the lower vane groove 128S, to the side opposite to the connection position between the compressor housing 10 and the upper inlet pipe 105 and the lower inlet pipe 104.

Therefore, a case of considering that the liquid refrigerant is unlikely to enter the inside of the upper compression chamber 133T and the inside of the lower compression chamber 133S according to the above-described relative positions of the upper discharge hole 190T and the lower discharge hole 190S, is preferable since, as the injection hole 140*b* is disposed to be within a fan-like range in which the center angle θ satisfies 15°≤θ, the liquid refrigerant is appropriately guided to the inside of the upper compression chamber 133T and the inside of the lower compression chamber 133S, and it is possible to reduce compression loss of the liquid refrigerant. In other words, a case where the injection hole 140*b* is disposed to be within a fan-like range in which the center angle θ satisfies 15°≤θ≤20°, is further more preferable.

In addition, in the circumferential direction of the rotation shaft 15, the injection hole 140*b* is disposed between one end of the protruding range in which the upper side protruding portion 122T and the lower side protruding portion 122S are provided along the circumferential direction of the rotation shaft 15, and the upper vane groove 128T and the lower vane groove 128S.

In addition, in the embodiment, the injection hole 140*b* is provided to penetrate along the thickness direction (the direction of the rotation shaft 15) of the intermediate partition plate 140, but the shaft direction of the center of the injection hole 140*b* is not limited to the direction of the rotation shaft 15. For example, in order to adjust the orientation or the like of injecting the liquid refrigerant to the inside of the upper compression chamber 133T and the inside of the lower compression chamber 133S, the center shaft of the injection hole 140*b* may be inclined with respect to the thickness direction of the intermediate partition plate 140 to inject the liquid refrigerant in the direction of being separated from the upper discharge hole 190T and the lower discharge hole 190S.

Effects of First Embodiment

As described above, the center of the injection hole 140*b* in the rotary compressor 1 according to the first embodiment is disposed to be within a fan-like range which is equal to or less than 40° toward the side opposite to the connection position between the compressor housing 10 and the upper inlet pipe 105 and the lower inlet pipe 104 from the center line of the upper vane groove 128T and the lower vane groove 128S, in the circumferential direction of the rotation shaft 15. Accordingly, the liquid refrigerant is injected at a timing of becoming equal to or less than the final ⅙ of the cycle (the center angle θ is equal to or less than 40°) in a later stage of the compression cycle of the refrigerant on the inside of the upper compression chamber 133T and on the inside of the lower compression chamber 133S, and the inlet amount of the liquid refrigerant which is suctioned to the inside of the upper compression chamber 133T and the inside of the lower compression chamber 133S is reduced to be an appropriate amount. As a result, it is possible to efficiently perform the remaining compression cycle which continues after the injection of the liquid refrigerant, and to improve the compression efficiency of the refrigerant.

Additionally, as the center of the injection hole 140*b* in the rotary compressor 1 according to the first embodiment is disposed to be within a fan-like range which is equal to or less than 20° from the center line of the upper vane groove 128T and the lower vane groove 128S, the inlet amount of the liquid refrigerant is further reduced to an appropriate amount, and it is possible to more efficiently perform the compression cycle after the injection of the liquid refrigerant, and to further improve the compression efficiency of the refrigerant.

In addition, the injection hole 140*b* in the rotary compressor 1 according to the first embodiment is more separated from the upper vane groove 128T and the lower vane groove 128S than the upper discharge hole 190T and the lower discharge hole 190S provided to be near the upper vane groove 128T and the lower vane groove 128S, in the circumferential direction of the rotation shaft 15. Accordingly, it is possible to prevent the liquid refrigerant injected to the inside of the upper compression chamber 133T and the inside of the lower compression chamber 133S from leaking and escaping from the upper discharge hole 190T and the lower discharge hole 190S.

In addition, the injection hole 140*b* in the rotary compressor 1 according to the first embodiment is disposed between one end of the protruding range in which the upper side protruding portion 122T and the lower side protruding portion 122S are provided along the circumferential direction of the rotation shaft 15, and the upper vane groove 128T and the lower vane groove 128S, in the circumferential direction of the rotation shaft 15. In the above-described first embodiment, the injection hole 140*b* is provided in the intermediate partition plate 140, but may be provided in the upper cylinder 121T and the lower cylinder 121S. In a case of a configuration in which the injection hole 140*b* is provided in the upper cylinder 121T and the lower cylinder 121S, as the injection hole 140*b* is disposed in the upper side protruding portion 122T and the lower side protruding portion 122S, it is possible to sufficiently ensure the length of the connection hole 140*a* to which the injection pipe 142 is fitted, with respect to the radial direction of the upper cylinder 121T and the lower cylinder 121S. Therefore, it is possible to improve reliability of the connection state between the upper cylinder 121T and the lower cylinder 121S and the injection pipe 142.

Modification Example of First Embodiment

The injection hole 140*b* in the embodiment is provided in the intermediate partition plate 140, but the injection hole 140*b* may be provided in each of the upper cylinder 121T and the lower cylinder 121S as described above, and the number of injection pipes 142 and injection connecting pipes is not respectively limited to one. In addition, the embodiment is described as a two-cylinder type rotary compressor, but may be employed in one-cylinder type rotary compressor.

Second Embodiment

Configuration of Rotary Compressor

Figure 6:
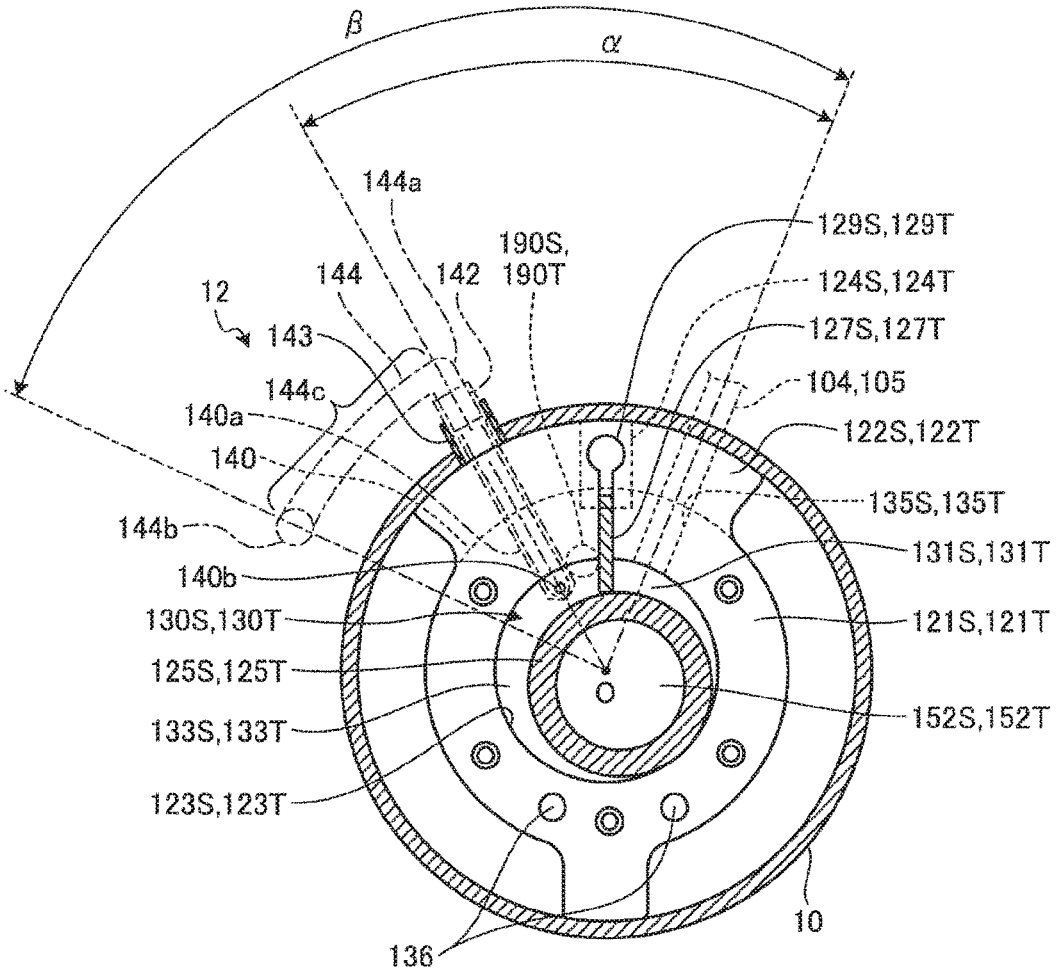
FIG. 6 is a lateral sectional view when the compressing unit of the rotary compressor according to the second embodiment is viewed from above.

FIG. 1 is a longitudinal sectional view illustrating a rotary compressor of a second embodiment. FIG. 2 is an exploded perspective view illustrating a compressing unit of the rotary compressor of the second embodiment. FIG. 6 is a lateral sectional view when the compressing unit of the rotary compressor of the second embodiment is viewed from above. In addition, substantially the same parts as those of the first embodiment are given the same reference numerals, and the description thereof will be omitted.

As illustrated in FIG. 6, in the lower cylinder 121S, the lower cylinder inner wall 123S is formed along the circle concentric to the rotation shaft 15 of the motor 11. On the inside of the lower cylinder inner wall 123S, the lower piston 125S which has the outer diameter smaller than the inner diameter of the lower cylinder 121S is disposed, and between the lower cylinder inner wall 123S and the lower piston 125S, the lower compression chamber 133S which suctions, compresses, and discharges the refrigerant is formed. In the upper cylinder 121T, the upper cylinder inner wall 123T is formed along the circle concentric to the rotation shaft 15 of the motor 11. In the upper cylinder inner wall 123T, the upper piston 125T which has the outer diameter smaller than the inner diameter of the upper cylinder 121T is disposed, and between the upper cylinder inner wall 123T and the upper piston 125T, the upper compression chamber 133T which suctions, compresses, and discharges the refrigerant is formed.

One end portion of the injection pipe 142 is disposed on the outer circumferential surface of the compressor housing 10, and is bonded to an injection pipe taking-out portion 143 which is configured of the pipe member which is provided to penetrate the compressor housing 10. In addition, one end portion of an injection connecting pipe 144 is bonded to the injection pipe taking-out portion 143. In this manner, in the injection pipe taking-out portion 143, a bonding part to which one end portion of the injection pipe 142 is welded, and a bonding part to which one end portion 144*a* of the injection connecting pipe 144 is welded, are provided. One end portion of an injection introduction pipe 145 to which the liquid refrigerant is introduced from a refrigerant circulating path is welded and connected to a connection portion 144*b* which serves as the other end portion of the injection connecting pipe 144, by the user when installing the rotary compressor 1 (refer to FIG. 7).

In the rotary compressor 1, the compression efficiency of the refrigerant is improved by injecting the liquid refrigerant introduced to the injection connecting pipe 144 from the injection introduction pipe 145 to the inside of the upper compression chamber 133T and the inside of the lower compression chamber 133S from each injection hole 140*b* of the intermediate partition plate 140 via the injection pipe 142, and by lowering the temperature of the refrigerant during the compression.

Characteristic Configuration of Rotary Compressor

Figure 7:
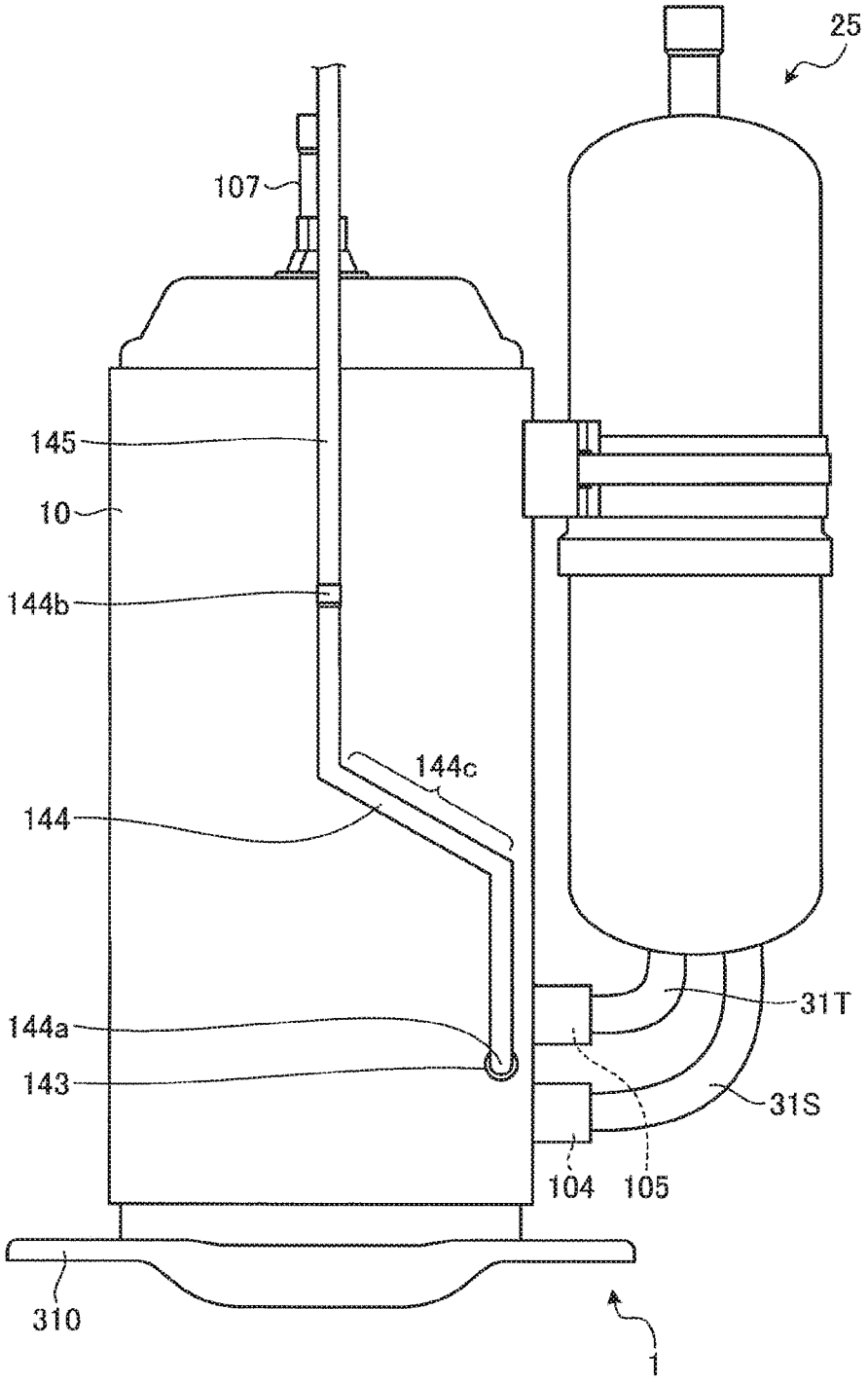
FIG. 7 is a side view illustrating an external appearance of the rotary compressor according to the second embodiment.
Figure 8:
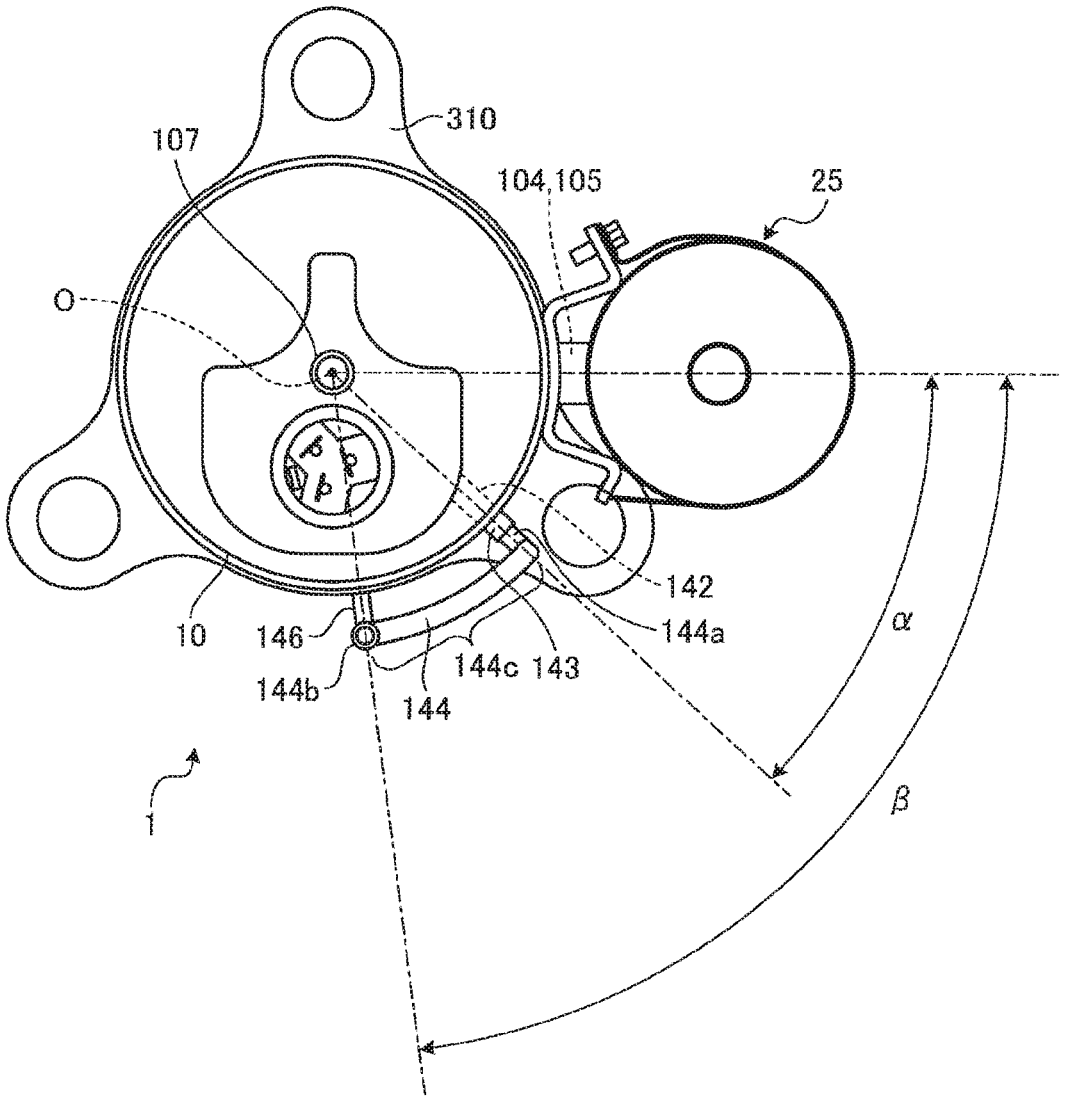
FIG. 8 is a plan view illustrating an external appearance of the rotary compressor according to the second embodiment.

Next, a characteristic configuration of the rotary compressor 1 according to the second embodiment will be described. FIG. 7 is a side view illustrating an external appearance of the rotary compressor 1 according to the second embodiment. FIG. 8 is a plan view illustrating an external appearance of the rotary compressor 1 according to the second embodiment.

As illustrated in FIGS. 6, 7, and 8, in the embodiment, in order to further improve the compression efficiency of the refrigerant by injecting the liquid refrigerant in a later stage of the compression cycle of the refrigerant on the inside of the upper compression chamber 133T and the inside of the lower compression chamber 133S, the injection hole 140*b* is disposed to approach the upper vane 127T side and the lower vane 127S side in the circumferential direction of the outer circumferential surface of the compressor housing 10. According to the disposition, the injection pipe 142 is disposed to approach the upper vane groove 128T and the lower vane groove 128S, and the upper inlet pipe 105 and the lower inlet pipe 104.

As illustrated in FIGS. 6 and 8, when viewed from the direction of the rotation shaft 15, in the circumferential direction of the outer circumferential surface of the compressor housing 10, the center line of the injection pipe 142 is disposed to be within a fan-like range in which the center angle $\alpha$ around the center O of the rotation shaft 15 is equal to or less than 60° toward the upper vane groove 128T side and the lower vane groove 128S side from the center line of the connection position between the compressor housing 10 and the upper inlet pipe 105 and the lower inlet pipe 104.

In the embodiment, the center angle $\alpha$ and a center angle $\beta$ which will be described later consider each center line along the radial direction of the rotation shaft 15 as a reference at the connection position between the upper inlet pipe 105 and the lower inlet pipe 104 and the compressor housing 10, and in the injection pipe 142 (connection hole 140*a*) and the connection portion 144*b* of the injection connecting pipe 144, and indicates an angle made by two line segments (radius) which link both ends of an arc and the center O of the rotation shaft 15 in the circumferential direction of the rotation shaft 15. In addition, in the embodiment, as illustrated in FIG. 6, the center of the injection hole 140*b* is positioned on the center line (on the center line of the connection hole 140*a* to which the injection pipe 142 is fitted) of the injection pipe 142 that extends in the radial direction of the rotation shaft 15. In addition, the center of the injection hole 140*b* is not limited to the configuration of being positioned on the center line of the injection pipe 142.

Disposition of Connection Portion of Injection Connecting Pipe

In the injection connecting pipe 144, as illustrated in FIGS. 6, 7, and 8, the one end portion 144*a* is linked to the injection pipe taking-out portion 143, and the connection portion 144*b* which serves as the other end portion extends along the direction of the rotation shaft 15 to the upper portion of the compressor housing 10, and an intermediate portion 144*c* in the longitudinal direction which is between both end portions extends in the circumferential direction of the outer circumferential surface of the compressor housing 10. The entire injection connecting pipe 144 extends along the outer circumferential surface of the compressor housing 10 at a predetermined interval with respect to the outer circumferential surface of the compressor housing 10. In addition, the one end portion 144*a* of the injection connecting pipe 144 extends, for example, only substantially by 10 mm, in the radial direction of the compressor housing 10, and the bonding part during the welding is appropriately ensured. In addition, on the outer circumferential surface of the compressor housing 10, as illustrated in FIG. 8, a holding stay 146 which holds the connection portion 144*b* of the injection connecting pipe 144 is fixed.

In the circumferential direction of the outer circumferential surface of the compressor housing 10, the center line of the connection portion 144*b* of the injection connecting pipe 144 is separated from the center line of the connection position between the upper inlet pipe 105 and the lower inlet pipe 104 toward the upper vane groove 128T side and the lower vane groove 128S side so that the center angle $\beta$ around the center O of the rotation shaft 15 is equal to or greater than 80°. Accordingly, welding tool avoids being interfered with the accumulator 25 during the welding work between the connection portion 144*b* of the injection connecting pipe 144 and the injection introduction pipe 145. A case where the center angle β made by the connection portion 144*b* around the center O of the rotation shaft 15 is less than 80°, is not preferable since there is a concern that the welding tool is interfered with the accumulator 25 during the welding work between the connection portion 144*b* of the injection connecting pipe 144 and the injection introduction pipe 145, and there is a concern that the welding work is interrupted.

In the embodiment, in the circumferential direction of the outer circumferential surface of the compressor housing 10, the upper inlet pipe 105 and the lower inlet pipe 104 are positioned at the same positions, but in the circumferential direction of the outer circumferential surface of the compressor housing 10, in a case where the upper inlet pipe 105 and the lower inlet pipe 104 are positioned at different positions, it is preferable that the center line of the connection portion 144*b* is separated from each of the center lines of both of the upper inlet pipe 105 and the lower inlet pipe 104 so that the center angle β is equal to or greater than 80° as described above. However, as the center line of the connection portion 144*b* is separated from at least one center line of the upper inlet pipe 105 and the lower inlet pipe 104 in the circumferential direction of the outer circumferential surface of the compressor housing 10 so that the center angle β is equal to or greater than 80° as described above, since the connection portion 144*b* is separated from the accumulator 25, the welding tool avoids being interfered with the accumulator 25.

In addition, the connection portion 144*b* is disposed at a position which opposes the outer circumferential surface of the compressor housing 10. In other words, the connection portion 144*b* is disposed at a midway position in the upward-and-downward direction (the direction of the rotation shaft 15) of the outer circumferential surface of the compressor housing 10, that is, within a range of a height of the compressor housing 10. In a case of this configuration, the welding tool is likely to come into contact with the outer circumferential surface of the compressor housing 10 when the welding work of the connection portion 144*b* is performed, and a posture of the welding tool is restricted by both of the outer circumferential surface of the compressor housing 10 and the outer circumferential surface of the accumulator 25. Therefore, as described above, as the connection portion 144*b* is separated from the connection position between the upper inlet pipe 105 and the lower inlet pipe 104, or from the upper vane groove 128T and the lower vane groove 128S in the circumferential direction of the outer circumferential surface of the compressor housing 10, since the welding tool avoids coming into contact with the outer circumferential surface of the accumulator 25, an effect of avoiding interruption of the welding work can be obtained.

Effects of Second Embodiment

As described above, in the rotary compressor 1 according to the second embodiment, the center line of the injection pipe taking-out portion 143 is disposed to be within a fan-like range in which the center angle α around the center O of the rotation shaft is equal to or less than 60° from the center line of the connection position between the compressor housing 10 and the upper inlet pipe 105 and the lower inlet pipe 104 toward the upper vane groove 128T side and the lower vane groove 128S side, in the circumferential direction of the outer circumferential surface of the compressor housing 10. The connection portion 144*b* which serves as the other end portion of the injection connecting pipe 144 extends in the direction of being separated from the upper inlet pipe 105 and the lower inlet pipe 104 in the circumferential direction of the outer circumferential surface of the compressor housing 10, and extends to the upper portion of the compressor housing 10. In other words, the connection portion 144*b* of the injection connecting pipe 144 is separated from the accumulator 25 in the circumferential direction of the outer circumferential surface of the compressor housing 10. Accordingly, since the welding tool (for example, a welding torch) avoids abutting against the accumulator 25 when welding the injection introduction pipe 145 to the connection portion 144*b* of the injection connecting pipe 144, it is possible to improve workability of welding the injection introduction pipe 145 to the connection portion 144*b* of the injection connecting pipe 144. As a result, since the welding work between the injection connecting pipe 144 and the injection introduction pipe 145 is appropriately performed, reliability of the bonding state caused by the welding between the injection connecting pipe 144 and the injection introduction pipe 145 is improved, and the accumulator 25 can avoid damage during the welding work. In addition, it is possible to avoid influence of the heat generated in the welding portion of the welding tool on the accumulator 25.

In addition, in the rotary compressor 1 according to the second embodiment, the center line of the connection portion 144*b* of the injection connecting pipe 144 is separated from the center line of the connection position between the compressor housing 10 and the upper inlet pipe 105 and the lower inlet pipe 104 toward the upper vane groove 128T side and the lower vane groove 128S side, in the circumferential direction of the outer circumferential surface of the compressor housing 10 so that the center angle β around the center O of the rotation shaft 15 is equal to or greater than 80°. Accordingly, the welding tool avoids interference with the accumulator 25 when performing the welding work between the connection portion 144*b* of the injection connecting pipe 144 and the injection introduction pipe 145, and workability of welding is efficiently improved.

In addition, the connection portion 144*b* of the injection connecting pipe 144 in the rotary compressor 1 according to the second embodiment is disposed at a position which opposes the outer circumferential surface of the compressor housing 10. When the connection portion 144*b* is disposed at a position which opposes the outer circumferential surface of the compressor housing 10, since the welding tool interferes with the accumulator 25 can be prevented when the welding work between the connection portion 144*b* of the injection connecting pipe 144 and the injection introduction pipe 145 is performed, workability of welding is efficiently improved.

In addition, the injection connecting pipe 144 in the rotary compressor 1 according to the second embodiment extends along the direction of the rotation shaft 15 to the upper portion of the compressor housing 10, and the intermediate portion 144*c* between both end portions extends in the circumferential direction of the outer circumferential surface of the compressor housing 10. In this manner, in the injection connecting pipe 144, as only the intermediate portion 144*c* partially extends with respect to the circumferential direction of the outer circumferential surface of the compressor housing 10, generation of stress concentration is avoided in both end portions when an external force, such as oscillation, is applied when transporting the rotary compressor 1, and reliability of a connected state of the injection connecting pipe 144 is improved.

In addition, in the injection connecting pipe 144 in the rotary compressor 1 according to the second embodiment, one end portion which is linked to the injection pipe taking-out portion 143 extends in the radial direction of the compressor housing 10. Accordingly, in the injection pipe taking-out portion 143, since the bonding part during the welding is appropriately ensured, it is possible to appropriately bond each of the injection pipe 142, the compressor housing 10, and the injection connecting pipe 144 by the welding.

In addition, the rotary compressor 1 according to the second embodiment is further provided with the holding stay 146 which is fixed to the outer circumferential surface of the compressor housing 10, and holds the connection portion 144*b*. Accordingly, when transporting the rotary compressor 1 after shipping the product, the injection connecting pipe 144 can avoid damage.

Modification Example of Second Embodiment

In the above-described injection connecting pipe 144, the connection portion 144*b* extends along the direction of the rotation shaft 15 to the upper portion of the compressor housing 10, but the shape thereof is not limited thereto. The injection connecting pipe 144 may extend along the outer circumferential surface of the compressor housing 10 being inclined with respect to the direction of the rotation shaft 15 toward the connection portion 144*b* from one end portion on the injection pipe taking-out portion 143 side. In addition, the injection connecting pipe 144 may be provided, for example, being smoothly curved in an S shape toward the connection portion 144*b* from the injection pipe taking-out portion 143 of the compressor housing 10, and can reduce flow resistance of the refrigerant.

The injection pipe 142 in the embodiment is provided in the intermediate partition plate 140, but the injection pipes 142 may be provided in each of the upper cylinder 121T and the lower cylinder 121S, and the number of injection pipes 142 and injection connecting pipes 144 is not limited to one. In addition, the embodiment is described as a two-cylinder type rotary compressor, but may be employed in one-cylinder type rotary compressor.

Above, the embodiments are described, but the embodiments are not limited to the above-described contents. In addition, in the above-described configuration elements, configuration elements which can be easily considered by those skilled in the art, and which are in substantially the same range, that is, a so-called equivalent range, are included. Furthermore, it is possible to appropriately combine the above-described configuration elements. Furthermore, at least any one of various omissions, replacements, and changes of the configuration elements can be performed within a range which does not depart from the scope of the embodiments.

What is claimed is:

1. A rotary compressor comprising:

a sealed vertically-placed cylindrical compressor housing in which a discharging unit for a refrigerant is provided in an upper portion, and an inlet unit for the refrigerant is provided in a lower portion;

a compressing unit which is disposed in the lower portion of an inside of the compressor housing, which compresses the refrigerant suctioned from the inlet unit, and which discharges the refrigerant from the discharging unit;

a motor which is disposed in the upper portion of the inside of the compressor housing, and which drives the compressing unit; and an accumulator which is fixed to an outer circumferential surface of the compressor housing, and which is connected to the inlet unit, wherein the compressing unit includes an annular cylinder, an upper end plate which closes an upper side of the cylinder, a lower end plate which closes a lower side of the cylinder, a rotation shaft which has an eccentric portion and which is rotated by the motor, a piston which is fitted to the eccentric portion, which revolves along an inner circumferential surface of the cylinder, and which forms a cylinder chamber on an inside of the cylinder, and a vane which protrudes to an inside of the cylinder chamber from a vane groove provided in the cylinder, and which divides the cylinder chamber into an inlet chamber and a compression chamber by abutting against the piston, the rotary compressor includes an injection pipe for injecting a liquid refrigerant to an inside of the compression chamber, an injection pipe taking-out portion which is provided on an outer circumferential surface of the compressor housing, and to which one end portion of the injection pipe is fixed, and an injection connecting pipe in which one end portion thereof is linked to the injection pipe via the injection pipe taking-out portion, a center line of the injection pipe taking-out portion is disposed to be within a range of a fan shape along a circumferential direction of the rotation shaft whose center angle around a center of the rotation shaft is equal to or less than 60° toward a vane groove side from a center line of a connection position between the compressor housing and the inlet unit, in a circumferential direction of the outer circumferential surface of the compressor housing, and the other end portion of the injection connecting pipe which extends in a direction away from the inlet unit in the circumferential direction of the outer circumferential surface of the compressor housing, and which extends to the upper portion of the compressor housing.

2. The rotary compressor according to claim 1, wherein a center line of the other end portion of the injection connecting pipe is separated from a center line of the connection position of the inlet unit by a center angle around the center of the rotation shaft which is equal to or greater than 80° toward the vane groove side, in the circumferential direction of the outer circumferential surface of the compressor housing.

3. The rotary compressor according to claim 1, wherein the other end portion of the injection connecting pipe is disposed at a position which opposes the outer circumferential surface of the compressor housing.

4. The rotary compressor according to claim 1, wherein, in the injection connecting pipe, both end portions extend along a rotation shaft direction to the upper portion of the compressor housing, and an intermediate portion of both end portions extends in the circumferential direction of the outer circumferential surface of the compressor housing.

5. The rotary compressor according to claim 1, wherein, in the injection connecting pipe, one end portion which is linked to the injection pipe taking-out portion extends in a radial direction of the compressor housing.

* * * * *